United States Patent [19]

Holleman

[11] 4,156,542

[45] May 29, 1979

[54] FIREPLACE IMPLEMENT

[75] Inventor: Howard A. Holleman, Bay Village, Ohio

[73] Assignee: Hydro Tube Corporation, Oberlin, Ohio

[21] Appl. No.: 810,806

[22] Filed: Jun. 28, 1977

Related U.S. Application Data

[63] Continuation-in-part of Ser. No. 714,819, Aug. 16, 1976.

[51] Int. Cl.[2] ..... A47J 49/06; F23L 5/00

[52] U.S. Cl. ..... 294/10; 239/530; D7/210

[58] Field of Search ..... 294/9, 10, 14; D7/210; 239/571, 530, 531; 110/182.5; 126/25 B

[56] References Cited

U.S. PATENT DOCUMENTS

| | | | |
|---|---|---|---|
| 1,813,285 | 7/1931 | Galetschky | 239/571 |
| 3,394,888 | 7/1968 | Dasse et al. | 239/571 |
| 3,850,374 | 11/1974 | Snoddy | 239/571 |

*Primary Examiner*—James B. Marbert
*Attorney, Agent, or Firm*—Burge & Porter Co.

[57] ABSTRACT

A blow-through fireplace implement for arranging and stimulating the burning of combustible materials includes an elongate structure having a handle formation near one end and a material-engaging formation near the other end. An inlet is defined by the handle structure. An outlet is defined by the material-engaging formation. A passage is formed through the structure for comunicating the inlet and the outlet. A valve is provided within the handle for selectively permitting gases to be blown into the inlet and discharged from the outlet to stimulate burning of combustible material, and for preventing gases entering the outlet from being drawn out through the inlet. The material-engaging formation includes a foot configured to rest flatly on the floor of a fireplace when the outlet is oriented in a preferred direction for stimulating the burning of combustible materials. When the structure is grasped by the handle formation, it can be manipulated to arrange combustible material in a fireplace by bringing the material-engaging formation into contact with the combustible material.

7 Claims, 8 Drawing Figures

FIREPLACE IMPLEMENT

CROSS-REFERENCE TO RELATED APPLICATION

The present application is a continuation-in-part of design patent application Ser. No. 714,819, filed Aug. 16, 1976 entitled FIREPLACE POKER.

BACKGROUND OF THE INVENTION

1. Field of The Invention

The present invention relates generally to blow-through apparatus for stimulating the burning of combustible materials.

2. Prior Art

Fireplace implements adapted to perform the dual functions of arranging and stimulating the burning of combustible materials in a fireplace are known. One such implement is described in U.S. Pat. No. 2,286,387, issued June 16, 1942, to J. H. Smith. Another is described in U.S. Pat. No. 2,579,805 issued Dec. 25, 1951, to W. R. Draeger.

The proposal of the Draeger patent calls for the use of an elongate tube having a pump structure provided therein for supplying air to combustible material in a fireplace. A transversely extending formation is provided at one end of the elongate tube and a somewhat backwardly-directed nozzle is provided at one end of the structure for discharging air. The end structure is described as being usable to arrange combustible materials in a fireplace.

The proposal of the Smith patent calls for the use of an elongate tube having one unheaded end into which one may blow, and having a head formed on the other end. The head has a pair of passages which parallel the axis of the tube for directing gases blown into the tube toward combustible materials in a fireplace to stimulate their burning. The head has a pointed tip and a transversely projecting prong to facilitate arranging combustible materials in a fireplace.

While the Smith proposal is preferable to that of Draeger due to its less expensive, substantially lighter-weight construction, the necessity for it to be positioned over and directed toward smoldering coals can result in heated combustion gases entering its discharge openings and traveling up the tube. These gases often have a noxious odor and are unpleasant to inhale.

A problem common to both proposals is that their elongate structures must be wholly supported and aimed by hand during use. Devices embodying the Draeger proposal are particularly awkward to use due to their relatively heavy construction and the backwards-directed orientation of their discharge nozzles.

SUMMARY OF THE INVENTION

The present invention overcomes the foregoing and other drawbacks of the prior art by providing a novel and improved, blow-through apparatus for stimulating the burning of combustible materials.

In accordance with the preferred practice of the present invention, a blow-through appliance for stimulating the burning of combustible materials includes an elongate structure having an inlet near one end, an outlet near the other end, and a passage communicating the inlet and the outlet. A valve is preferably provided for selectively permitting gases to be blown into the inlet for discharge through the outlet, and for preventing gases entering the outlet from being drawn out through the inlet. The valve is preferably housed within a handle which defines the inlet. The outlet is preferably defined by a transversely extending formation which is adapted to engage and arrange combustible materials, and which includes a foot portion adapted to support the appliance in a preferred orientation during its use to stimulate burning.

One feature of the invention is its extremely simple construction. It is preferably formed using a length of steel tubing which is open at its upper end and crimped closed at its lower end. The transversely extending formation preferably comprises a single metal bar having a mounting hole formed therethrough. The steel tube extends through the mounting hole and is welded to the bar in the vicinity of opposite ends of the mounting hole. The bar has arm portions which project from opposite sides of the tube. AT least one hole is drilled in one of the arm portions to define the outlet and to establish communication between the outlet and the passage within the tube. The other arm is curved and defines the foot portion.

The handle formation is a wood turning having a hole formed centrally therethrough. The open upper end of the tube is press-fitted into one end of the handle hole, and the other end of the handle hole defines the inlet. The valve includes an annular shoulder formed in the handle hole to provide a valve seat, and a ball-shaped valve member positioned between the valve seat and the open upper end of the tube. Either a stop pin or a biasing spring is used to prevent the ball from seating against the upper end of the tube.

In operation, the appliance can be used to arrange combustible materials by grasping its handle and by bringing either the closed lower end of its tube or the foot-portion of the transversely extending member into engagement with the combustible materials. The appliance is used to stimulate burning of combustible materials by positioning its foot portion flatly on the floor of a fireplace to support the appliance with its outlet directed toward the combustible materials, and by blowing into the inlet. The valve carried in the handle helps assure that gases entering the outlet from the vicinity of the outlet are not drawn out through the inlet. Since the outlet is normally positioned forwardly of and below the combustible materials to be stimulated, hot combustion gases do not normally flow into the outlet as is encountered in prior proposals.

As will be apparent from the foregoing summary, it is a general object of the present invention to provide a novel and improved blow-through apparatus for stimulating the burning of combustible materials.

It is a further object of the invention to provide a blow-through implement of the type having a supporting foot structure at its lower end for advantageously directing the discharge of gases from the implement toward smoldering coals.

It is still another object of the present invention to provide an implement of the type described including a valve to minimize the possibility of combustion gases being drawn in through the outlet and out the inlet.

These and other objects and a fuller understanding of the invention described and claimed in the present application may be had by referring to the following description and claims taken in conjunction with the accompanying drawing.

DESCRIPTION OF THE PREFERRED EMBODIMENT

Figure 1:
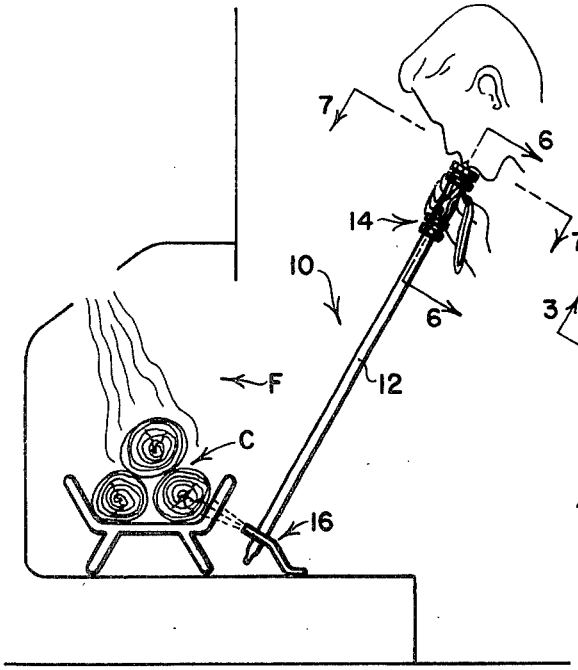
FIG. 1 is a somewhat schematic side elevational view showing a fireplace implement embodying the preferred practice of the present invention being used to stimulate the burning of combustible material in a fireplace.

Referring to FIG. 1, a fireplace implement embodying the preferred practice of the present invention is indicated generally by the numeral 10. The implement 10 includes an elongate tube 12, a handle structure 14 provided at one end of the elongate tube 12, and a transversely extending material-engaging structure 16 provided at the other end of the elongate tube 12.

Figure 2:
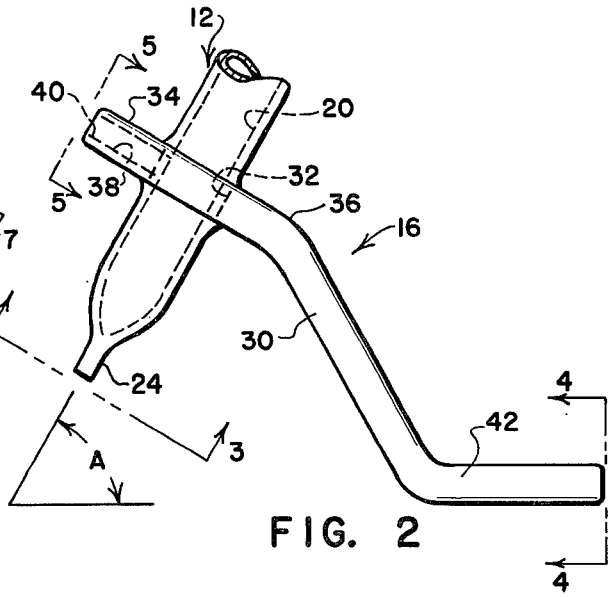
FIG. 2 is an enlarged side elevational view of a portion of the implement of FIG. 1.
Figure 3:
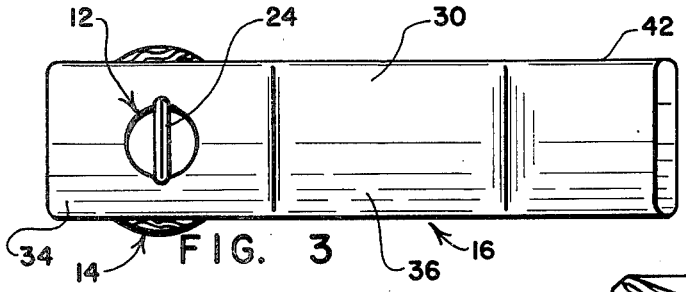
FIGS. 3, 4 and 5 are views as seen from planes indicated by lines 3—3, 4—4, and 5—5 in FIG. 2.
Figure 4:
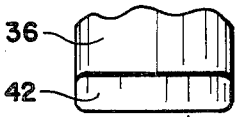
Figure 5:
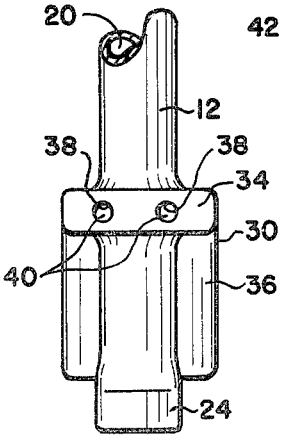

The elongate tube 12 is preferably formed from steel and has a passage 20 extending centrally therethrough. The tube 12 has an open upper end 22, as is best seen in FIG. 2. The tube 12 has a lower end 24 which is crimped to form an airtight closure, as best seen in FIGS. 2, 3 and 5.

Referring to FIGS. 2-5, the transversely extending material-engaging structure 16 is formed from a single bar of steel 30 through which a mounting hole 32 is provided. The tube 12 extends through the mounting hole 32 and is secured to the bar 30 by welding in the vicinity of opposite ends of the mounting hole 32.

The structure 16 has arm portions 34, 36 which extend in opposite directions from the tube 12. As is best seen in FIGS. 2 and 5, a pair of holes 38 are formed in the arm portion 34. The outer ends of the holes 38 define a pair of outlet openings which will collectively be referred to as an outlet 40. The holes 38 are drilled through the arm portion 34 and through the wall of the tube 12 to communicate with the passage 20. The holes 38 extend in a plane which is substantially perpendicular to the axis of the tube 12, and have a combined cross-sectional area which is substantially less than that of the passage 20.

Referring to FIG. 2, the arm portion 36 is substantially longer than the arm portion 34 and is curved along its length to define a foot portion 42 at its outer end. The foot portion 42 is configured to rest flatly on the floor of a fireplace when the tube 12 is oriented such that its axis forms an angle A of about 60 degrees with the floor of the fireplace. When the implement 10 is oriented in this manner, the holes 38 are directed upwardly at an angle of about 30 degrees to the floor of the fireplace. As is illustrated in FIG. 1, this particular positioning of the implement 10 is well suited for use in stimulating the burning of combustible materials C such as logs supported in a fireplace F.

Figure 7:
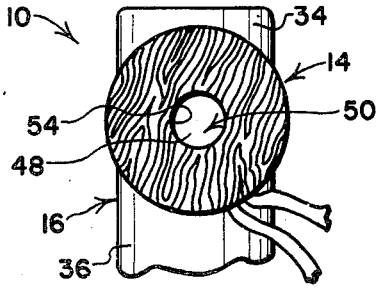
FIG. 7 is an enlarged view as seen from a plane indicated by a line 7—7 in FIG. 1; and, FIG. 8 is a sectional view similar to FIG. 6 showing an alternate embodiment.
Figure 6:
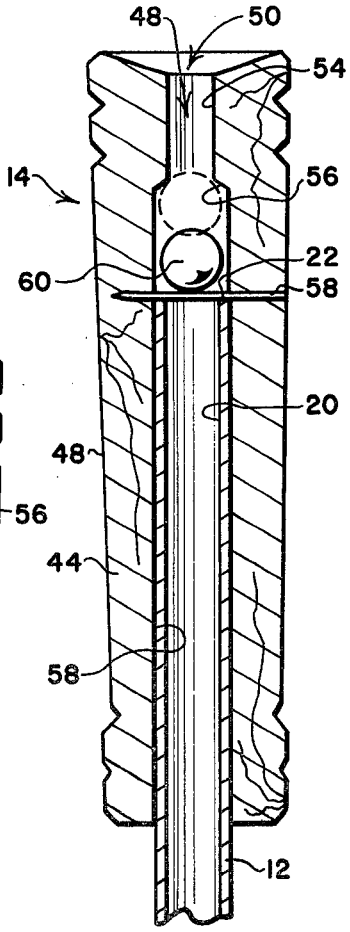
FIG. 6 is an enlarged sectional view as seen from a plane indicated by a line 6—6 in FIG. 1.

Referring to FIGS. 6 and 7, the handle structure is preferably formed as a wood turning 44 and has a generally cylindrical outer surface 46 provided with suitable circumferentially extending grooves and the like for decoration. A hole 48 is formed through the handle structure. The upper end of the hole 48 defines an inlet 50.

The hole 48 has a lower end region 52 of relatively large diameter into which the upper end region of the tube 12 is press fitted for secure connection to the handle structure 14. The hole 48 has a smaller diameter upper end region 54 which is separated from the lower end region by a substantially annular shoulder 56. A pin 58 extends diametrically of the hole portion 52 at a location spaced from the shoulder 56. A ball-shaped valve member 60 having a diameter smaller than that of the lower hole portion 52 but larger than that of the upper hole portion 54, is positioned between the pin 58 and the shoulder 56. The ball 60 is preferably formed from light-weight plastic material and forms part of a valve adapted to permit gases to be blown in through the inlet 50 opening for discharge through the outlet 40, and for preventing gases entering the outlet 40 being drawn out through the inlet 50. The pin 58 serves the dual functions of providing a means for locating the upper end of the tube 12 when it is pressed into the hole portion 52, and of preventing the ball 60 from sealingly engaging the open end 22 of the tube 12.

In operation, once the implement 10 is positioned as shown in FIG. 1 for stimulating the burning of combustible materials in a fireplace, the operator blows into the inlet 50 with a gentle and constant pressure. Since the holes 38 are substantially smaller in total cross-sectional area than is the area of the passage 20, gases will discharge from the implement 10 at a substantially greater velocity than they are blown into the inlet. These gases, supplied by the breath of the operator, contain sufficient oxygen to rekindle smoldering coals and to promote burning of combustible materials in the fireplace. If, between breaths, the operator should accidentally inhale while his mouth is still in communication with the inlet 50, the plastic ball 60 will be drawn upwardly into seating engagement with the annular shoulder 56, as shown in phantom in FIG. 6, and will prevent the passage out the inlet 50 of such combustion gases as may enter the outlet 40.

The implement 10 may be used to arrange combustible materials in a fireplace by grasping the handle structure 14 in one hand and manipulating the implement 10 to bring either the lower end 24 of the tube 12 or the arm portion 36 including the foot 42 into engagement with the combustible materials.

Figure 8:
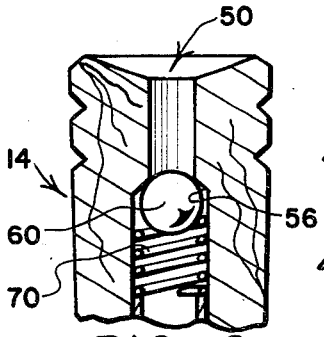

Referring to FIG. 8, a compression coil 70 spring can be inserted between the end 22 of the tube 12 and the ball 60 to normally bias the ball 60 into engagement with the shoulder 56. Where the spring 70 is utilized, it serves the function of preventing the ball 60 from sealingly engaging the upper end 22 of the tube 12, thereby permitting the elimination of the pin 58. When an operator blows into the inlet 50, the gentle pressure of his breath overcomes the biasing action of the spring 70 and causes the ball 60 to move away from the shoulder 56 to permit the passage of the operator's breath into the passage 20 for discharge through the holes 38. As soon as the operator stops blowing into the inlet 50, the biasing action of the spring 70 raises the ball 60 into seating engagement with the shoulder 56 and prevents the passage out through the inlet 50 of such gases as may enter the outlet holes 38.

As will be apparent from the foregoing description, the present invention provides a novel and improved fireplace implement for arranging and stimulating the burning of combustible materials. While the appliance described is particularly well adapted for use in conjunction with the burning of combustible materials in fireplaces, it will be apparent that features of the invention are also well adapted for use in arranging and stimulating the burning of such combustible materials as charcoal in charcoal grills and the like.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A blow-through fireplace poker for arranging and stimulating the burning of combustible material in a fireplace, comprising:

(a) a rigid elongate tubular member having an open end, and a passage extending from the open end along a longitudinal axis of the tubular member toward the opposite end of the tubular member, the opposite end being crimped closed;

(b) an elongate handle member having a hole formed therethrough, the tubular member being received snugly within one end region of the hole to mount the handle member on the tubular member, the other end region of the hole defining an inlet for admitting air to the passage;

(c) the open end of the tubular member being located within and in communication with the hole, the open end of the tubular member defining a valve seat;

(d) a transversely extending member carried by the tubular member near its opposite end, the transversely extending member having a central portion with a mounting hole formed therethrough, the tubular member having a round outer wall portion extending through the mounting hole and being rigidly secured to the transversely extending member within the vicinity of the mounting hole;

(e) the transversely extending member having a pair of arm portions which extend in opposite directions from the tubular member, one of the arm members extending a relatively short distance in a direction perpendicular to the longitudinal axis of the tubular member, the other of the arm members extending a relatively longer distance in the generally opposite direction and having foot formation means provided near the end thereof with a surface formed thereon for engaging the floor of a fireplace and supporting the poker at a predetermined angle of orientation relative to the floor of the fireplace;

(f) at least one hole formed through the one arm portion and through an adjacent wall portion of the tubular member to communicate the at least one hole with the passage provided in the tubular member, the at least one hole extending in a plane substantially perpendicular to the longitudinal axis of the tubular member and providing an outlet for discharge of air admitted to the passage through the inlet; and, (g) valve means carried within the hole and being movable between a first position of sealing engagement with the valve seat and a second position out of sealing engagement with the valve seat for selectively preventing and permitting a flow of air to travel from the hole in the handle member into the passage in the tubular member, the valve means being operative to prevent gases entering the outlet from being drawn out through the inlet.

2. The blow-through poker of claim 1 wherein the valve seat is annular, and the valve means comprises a ball which is movable into and out of engagement with the annular valve seat.

3. The blow-through poker of claim 2 wherein the valve means includes biasing means for biasing the ball toward a position of sealing engagement with the valve seat.

4. The blow-through poker of claim 1 wherein the valve means is responsive to the blowing of gases into the inlet to establish communication between the inlet and the outlet.

5. The blow-through poker of claim 1 wherein the valve means is responsive to an attempt to draw gases out of the inlet to close off communication between the inlet and the outlet.

6. The blow-through poker of claim 1 additionally including a stop pin provided adjacent the one end of the tube and extending substantially diametrically of the hole.

7. The blow-through poker of claim 1 wherein the surface on the foot formation means extends in a plane which intersects the longitudinal axis at an angle of about 60°.

* * * * *